US007451687B2

(12) United States Patent
Lynn et al.

(10) Patent No.: US 7,451,687 B2
(45) Date of Patent: Nov. 18, 2008

(54) HYBRID NUTATING PUMP

(75) Inventors: William Harry Lynn, Kohler, WI (US); Roy Razek, Plymouth, WI (US)

(73) Assignee: Thomas Industries, Inc., Sheboygan, WI (US)

( * ) Notice: Subject to any disclaimer, the term of this patent is extended or adjusted under 35 U.S.C. 154(b) by 306 days.

(21) Appl. No.: 11/275,402

(22) Filed: Dec. 29, 2005

(65) Prior Publication Data

US 2007/0128051 A1 Jun. 7, 2007

Related U.S. Application Data

(63) Continuation-in-part of application No. 10/595,005, filed on Dec. 7, 2005, now Pat. No. 7,302,883.

(51) Int. Cl.
*F01B 13/04* (2006.01)
*F04F 1/12* (2006.01)

(52) U.S. Cl. ..... 92/12.2; 74/60; 91/499

(58) Field of Classification Search ..... 91/499; 92/12.2, 71, 181 R–181 P; 417/269, 550; 74/60, 839

See application file for complete search history.

(56) References Cited

U.S. PATENT DOCUMENTS 2,107,090 A 2/1938 Swennes
2,169,456 A * 8/1939 Wahlmark ..... 92/71
2,214,390 A 9/1940 Wahlmark
2,237,518 A * 4/1941 Blum ..... 92/71
2,451,379 A * 10/1948 Burke ..... 92/71
2,625,914 A * 1/1953 Pressler ..... 92/71
3,180,159 A 4/1965 Georges
4,153,391 A 5/1979 Hartley
4,283,997 A * 8/1981 Takahashi et al. ..... 417/269
4,290,345 A * 9/1981 Hiraga et al. ..... 417/269

(Continued)

FOREIGN PATENT DOCUMENTS

WO 2004/113724 A2 12/2004

OTHER PUBLICATIONS

Innovation Engineering, Inc. Engine Technology International, Sep. 2003, 4 pages.

*Primary Examiner*—Thomas E Lazo
(74) *Attorney, Agent, or Firm*—James B. Conte; Husch Blackwell Sanders LLP

(57) ABSTRACT

A nutating pump for creating pressure or a vacuum. The nutating pump includes a housing with a center support positioned within said housing. The center support includes a semi-spherical recess. The pump also includes a drive shaft adapted to be connected to an electric motor and an eccentric adapted to be connected to the drive shaft. The pump further includes a ball adapted to form a ball joint and is adapted to be positioned within the semi-spherical recess of said center support. In addition the pump includes a nutating yoke positioned within the housing. The yoke includes a semi-spherical recess adapted to accept said pivot ball. The nutating yoke is adapted to be connected to the eccentric, such that rotation of the eccentric causes the yoke to move about the ball. The pump also includes a connecting rod connected to the yoke, a piston connected to the connecting rod and a cylinder adapted to accept the piston, wherein the movement of the yoke about the ball causes the piston to reciprocate within the cylinder.

20 Claims, 8 Drawing Sheets

U.S. PATENT DOCUMENTS 4,507,058 A 3/1985 Schoenmeyr
4,717,313 A * 1/1988 Ohno et al. ..... 417/269
4,801,249 A 1/1989 Kakizawa
4,852,418 A 8/1989 Armstrong
4,934,253 A 6/1990 Berthold et al.
4,976,284 A * 12/1990 Hovarter ..... 417/269
5,007,385 A 4/1991 Kitaguchi
5,076,764 A * 12/1991 Kawai et al. ..... 91/499
5,079,996 A * 1/1992 Abousabha et al. ..... 92/71
5,094,590 A * 3/1992 Carella et al. ..... 92/71
5,147,190 A * 9/1992 Hovarter ..... 417/269
5,163,819 A * 11/1992 Pettitt ..... 417/269
5,415,077 A * 5/1995 Ono ..... 92/71
5,476,371 A * 12/1995 Dreiman ..... 92/181 P
5,632,607 A 5/1997 Popescu et al.
5,791,882 A 8/1998 Stucker et al.
5,795,139 A * 8/1998 Ikeda et al. ..... 417/269
5,800,136 A 9/1998 Kurth et al.
5,826,488 A * 10/1998 Arai et al. ..... 92/71
5,960,697 A * 10/1999 Hayase et al. ..... 92/71
5,992,357 A 11/1999 Tasi
6,048,183 A 4/2000 Meza
6,056,514 A * 5/2000 Fukai ..... 92/71
6,074,174 A 6/2000 Lynn et al.
6,099,268 A * 8/2000 Pressel ..... 417/360
6,179,576 B1 * 1/2001 Morita ..... 417/269
6,234,769 B1 5/2001 Sakai et al.
6,239,839 B1 5/2001 Matsunaga et al.
6,264,438 B1 * 7/2001 Fukami ..... 92/71
6,439,857 B1 8/2002 Koelzer et al.
6,450,777 B2 9/2002 Lynn et al.
6,716,005 B2 * 4/2004 Yamakawa ..... 92/71
6,866,484 B2 3/2005 Reitzig
6,968,751 B2 11/2005 Shulenberger et al.
7,025,575 B2 4/2006 Noh et al.
7,134,381 B2 * 11/2006 Ueno et al. ..... 92/71
7,325,476 B2 2/2008 Sanderson ..... 92/12.2
7,331,271 B2 2/2008 Sanderson et al. ..... 92/12.2
2002/0127116 A1 9/2002 Koelzer et al.
2003/0002990 A1 1/2003 Reitzig
2006/0239839 A1 10/2006 Ephshteyn
2008/0050251 A1 2/2008 Zabar ..... 417/413.1

* cited by examiner

HYBRID NUTATING PUMP

This application is a continuation-in-part of U.S. patent application Ser. No. 10/595,005 filed on Dec. 7, 2005.

FIELD OF THE INVENTION

This invention relates to pumps, and in particular, to nutating pumps.

BACKGROUND OF THE INVENTION

Nutation pumps having a nutating member that has a circular rocking or wobble type of motion to reciprocate pistons so as to result in pumping action are known. For example, U.S. Pat. No. 5,007,385 discloses such a mechanism that uses either a spherical bearing or alternatively a cross-type universal joint between the wobble member and the housing. The wobble member is driven eccentrically by a drive shaft and has arms joined by ball joints or other pivot joints to pistons that reciprocate linearly.

These types of mechanisms have typically had many sliding surfaces and, therefore, many bearings, each making the whole construction relatively complex, difficult to assemble, and expensive.

SUMMARY OF THE INVENTION

The invention provides a nutating pump in which a cross-type universal joint connects the nutating member to the housing, ball joints connect the nutating member to the piston rods, and the piston rods are fixed to the piston heads so that the piston heads wobble in the pump cylinders. This eliminates a bearing connection between the piston rod and the piston head, while achieving the benefits of using a universal joint to connect the nutating member to the housing to take side loads off of the piston heads.

In another aspect of the invention, the piston rods are made relatively long so as to minimize the wobble motion of the piston heads in the pump cylinders. The longer that the piston rods can be made, the less that the piston heads will wobble in the pump cylinders. In other words, for example for the 12° tilt angle of the universal joint, with a sufficiently long piston rod, the piston head will only tilt 1°. Such a low tilt of the piston head from being axially aligned in the pump cylinder allows the use of either a piston cup, as is common in wobble pistons, or of a split-ring seal (a split-ring being of the type that is commonly used in internal combustion reciprocating engines and some reciprocating pumps). Split-ring seals are generally regarded as providing very long wear-life and low blow-by leakage, whereas a wobble piston cup provides adequate sealing with a relatively larger angle of tilt of the wobble piston head.

It is desirable to use a universal joint to connect the nutating member to the housing because the universal joint is capable of carrying the torsional loading to which the wobble member is subjected, reducing side loading on the pistons. Side loading on the pistons results in increased wear, shorter life, and more blow-by leakage over the life of the pump.

In addition, a long stroke which is enabled by the U-joint and also by the use of the socket joints to connect the wobble member to the piston rods provides higher flow in a small space, which is significantly higher than other types of nutating pump designs. Allowing use of split-ring seals instead of piston cups also helps reduce frictional loading and provides better efficiency.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
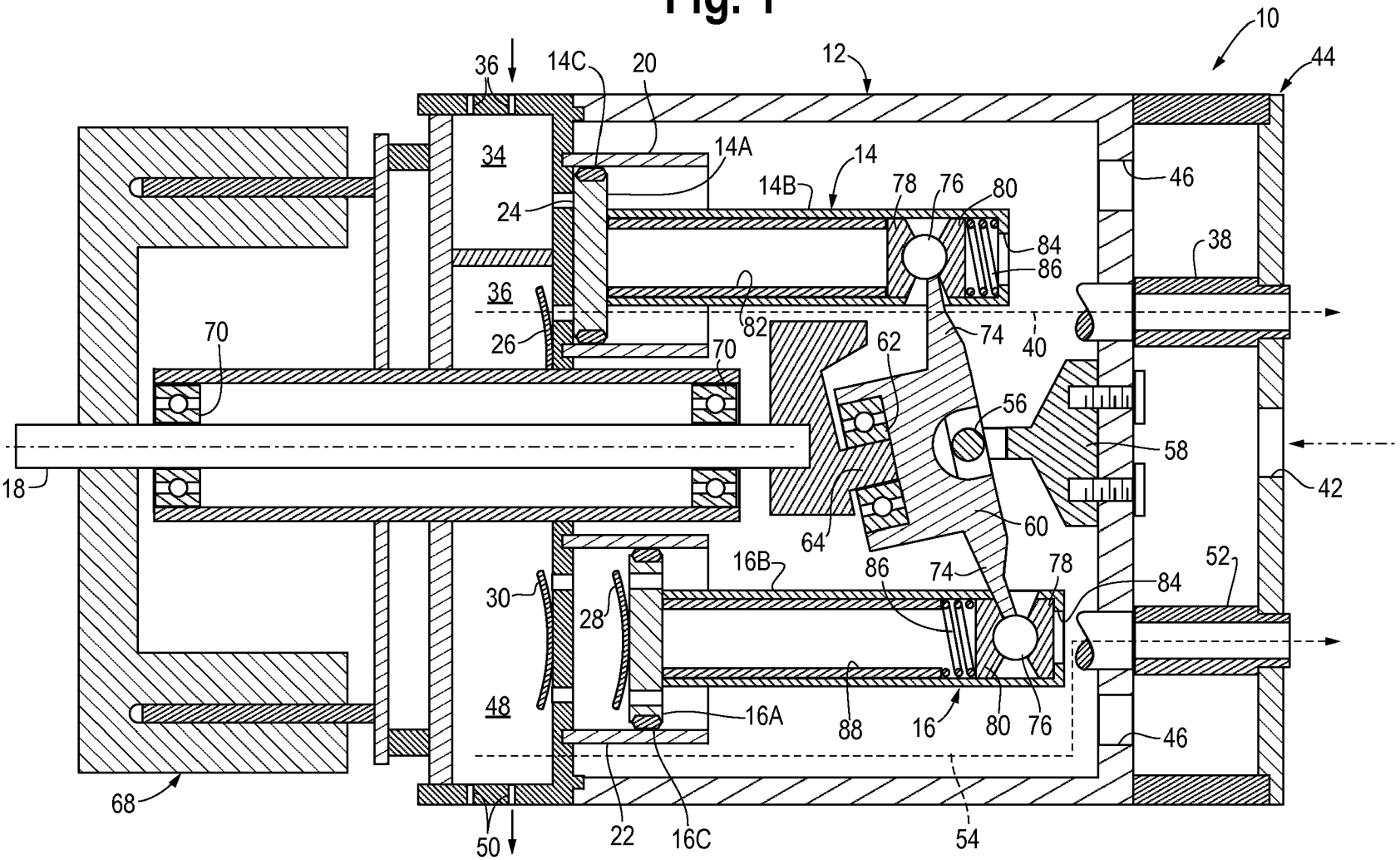
FIG. 1 is a cross-sectional, schematic view taken on a 90° cross-section line illustrating a pump incorporation the invention.

A pump 10 of the invention has a housing 12 which may be made in any number of pieces, a pair of compression pistons 14 opposite from one another (only shown, the other one would be 180° apart from the one shown, FIG. 1 being a 90° cross-sectional view), a pair of vacuum pistons 16 (only one shown, the other vacuum piston 16 being opposite from the one shown, 180° spaced therefrom about the axis of drive shaft 18). Each piston 14, 16 has a head 14A or 16A and a rod 14B or 16B, respectively. The heads 14A and 16A reciprocate with a slight wobble motion in respective pump cylinders 20 and 22. Heads 14A and 16A have respective split ring deals 14C, 16C, preferably made of a polytetrafluoroethylene composite material that establish a sliding seal with the walls of the cylinders 10, 22 and are preferably radiused on their outside surfaces with a radius equal to the cylinder radius to maintain good sealing as the piston wobbles in the cylinder. Intake valve 24 and exhaust valve 26 are provided respectively to and from the pumping chamber in cylinder 20 and intake valve 28 and exhaust valve 30 are provided respectively to and from the pumping chamber in the cylinder 22. The invention could also be applied to a pressure-only or a vacuum-only pumps, and in that case it would be desirable to provide an odd number of pistons, e.g., three or five, to minimize gas pulsations.

Intake air for cylinder 20 comes into intake chamber 34 through holes 36 and compressed air exits cylinder 20 past valve 26 into exhaust chamber 36 and from exhaust chamber 36 through connector tube 38 which as indicated by dashed line 40, is in communication with the chamber 36. Intake for the vacuum cylinder 22 comes through hole 42 into sound attenuator housing 44 and through holes 46 into the interior of the housing 12 where it can pass through the piston head 16A past the valve 28 into the pumping chamber of the cylinder 22. Compressed exhaust air from the vacuum cylinder 22 passes by the valve 30 into exhaust chamber 48 and out of the exhaust chamber 48 either through holes 50 or alternatively through a connector tube 52 that, as illustrated by the dashed line 54 as in communication with the chamber 48. The connector tubes 38 and 52 pass through the attenuator chamber 44 so that all the connections for the pump, including the intake 42 to the vacuum chamber and the exhausts from the pressure and vacuum pumps, can all be provided at the end of the pump. If desired, a connector tube like the tubes 38 and 52 could also be provided for the intake for the pressure cylinder 20.

A cross-type universal joint 56 has two of its opposed arms journalled to connector 58 and the other two of its opposed arms (which are at 90° to the first two opposed arms mentioned) journalled to wobble member 60. "Opposed" as used herein means that the two arms are 180° apart. Wobble member 60 mounts the outer race of a bearing is pressed onto an eccentric stub shaft 64 which is fixed off-center and at an angle to drive shaft 18. Drive shaft 18 is driven by motor 68 which has its stator fixed to the housing 12 and is journalled by bearings 70 to the housing 12. The center of the universal joint 56 is on the axis of shaft 18. When the shaft 18 is rotated, the universal joint 56 permits the eccentric 64 to impart a wobbling motion to the wobble member 60 such that the two compression pistons 14 (which are 180° relative to each other about the axis of shaft 18) are 180° out of phase with one another and the two vacuum pistons 16, which are at 90° to the compression pistons 14 about the axis of shaft 18 (and which are 180° relative to each other about the axis of shaft 18), are 180° out of phase with one another.

The wobble member 60 has arms 74 which extend from it to the four piston rods 14B and 16B. The arms 74 extend into the respective piston rods and at their ends have ball head 76. The piston rods 14B and 16B are hollow and contain within them each a fixed socket half 78 and a biased socket half 80. Each fixed socket half 78 of the compressor piston rods 14B is held at a constant spacing from the piston head 14A by a spacer tube 82 which is contained within the rod 14B and the fixed socket half 78 of the vacuum piston rod 16B is held at a fixed spacing from the vacuum piston head 16A by the rod 16B being crimped over at its end 84. Biased socket half 80 of each compression piston rod 14B is biased toward the ball head 76 and toward the piston head 14A by a spring 86 which is held in the rod 14B by the crimp end 84. The socket half 80 of the vacuum piston 16 is biased against the ball head 76 and away from the piston head 16A by a spring 86, which has its other end acting against the spacer tube 88 inside each piston rod 16B. The springs 86 provide a preload on the ball heads 76 and are not subjected to forces (other than the ones they exert) on the working strokes of the respective pistons. That is because a rigid connection is provided between the ball head 76 and the compressor piston head 14A by the spacer tube 82 and the socket half 78 on the power stroke of the compressor piston (i.e. going toward top dead center) and a rigid connection is provided between the ball head 76 and the vacuum piston head 16A on its power stroke (i.e. going toward bottom dead center) by the socket half 78 and the piston rod 16B being crimped over it. Alternatively, the ball and socket joint could be reversed, with the balls on the piston rods 14B, 16B and the sockets on the wobble member 60.

Alternatively, in a compressor application, a nutating pump 100, of the type shown in FIGS. 2 through 10, is designed to effectively reciprocate pistons to create a pumping action. The nutating pump 100, best shown in FIG. 2 and 3, includes a housing 102 secured to a valve head 104 and valve plate 106 by use of a plurality of fasteners 108. The housing 102 is aligned with the valve head 104 and valve plate 106 by use of alignment pins 110. While alignment pins 110 are shown, it is contemplated that other alignment means could be utilized to properly align the housing 102 with the valve head 104 and valve plate 106, including molded alignment channels, tabs and the like.

Figure 3:
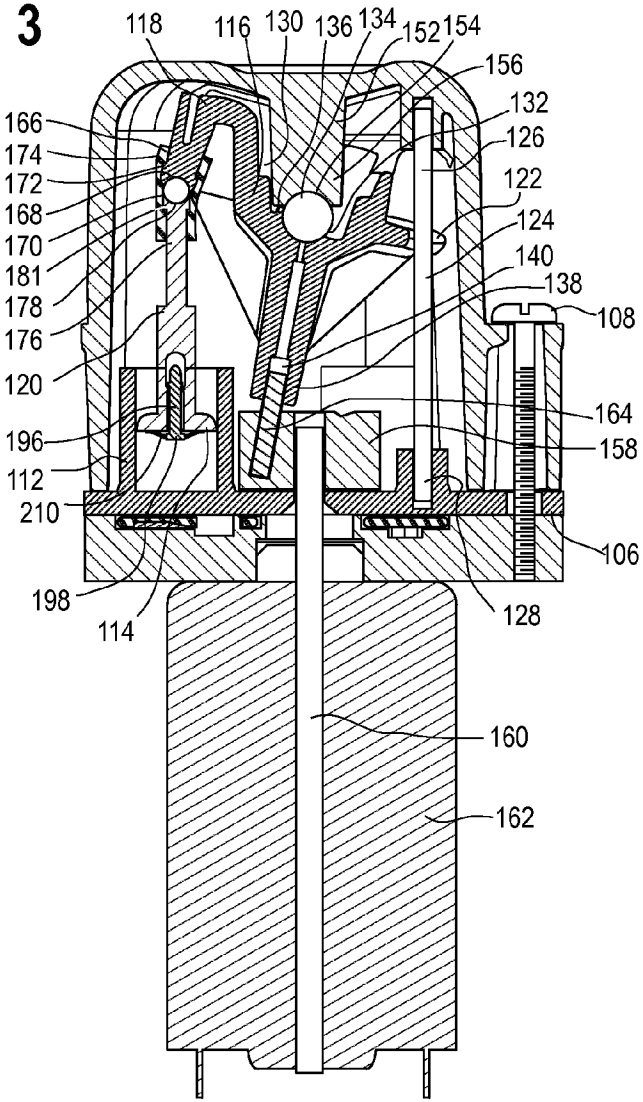
FIG. 3 is a cross sectional, schematic view of the pump.
Figure 2:
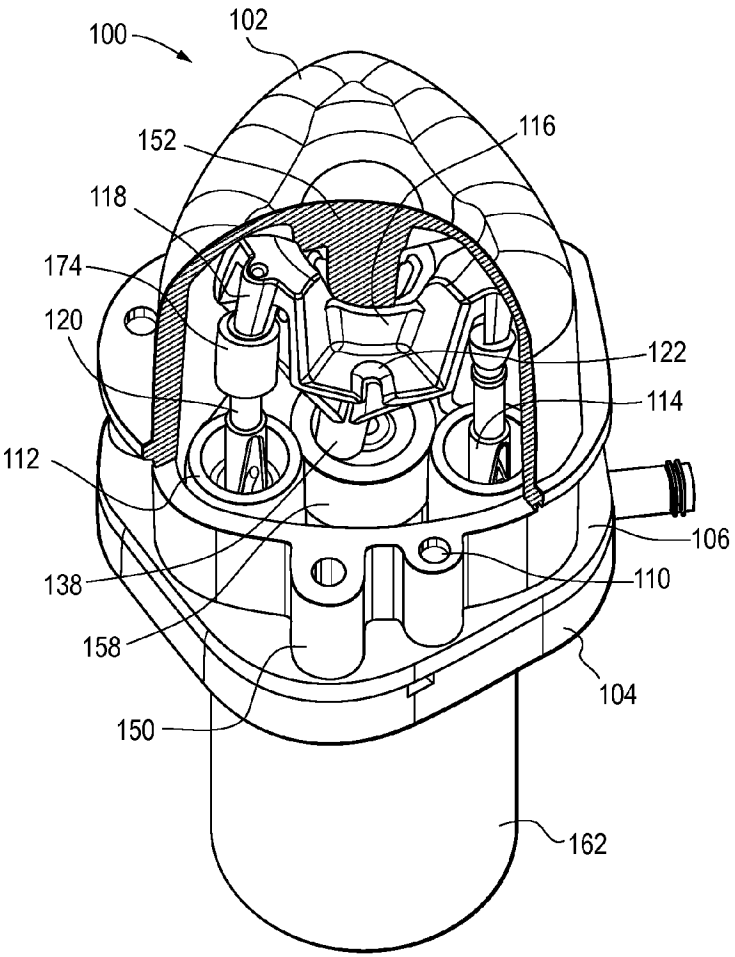
FIG. 2 is a perspective view of an alternate embodiment of a pump.

FIGS. 2 and 3 illustrate the cylinders 112 and pistons 114. The nutating pump 100 of the present disclosure is a three cylinder design and includes a yoke 116 that is designed to wobble or nutate about a given point. While three cylinders are shown, it is contemplated that one, two, three or more cylinders could be used and still fall within the scope of the claimed invention.

Figure 5:
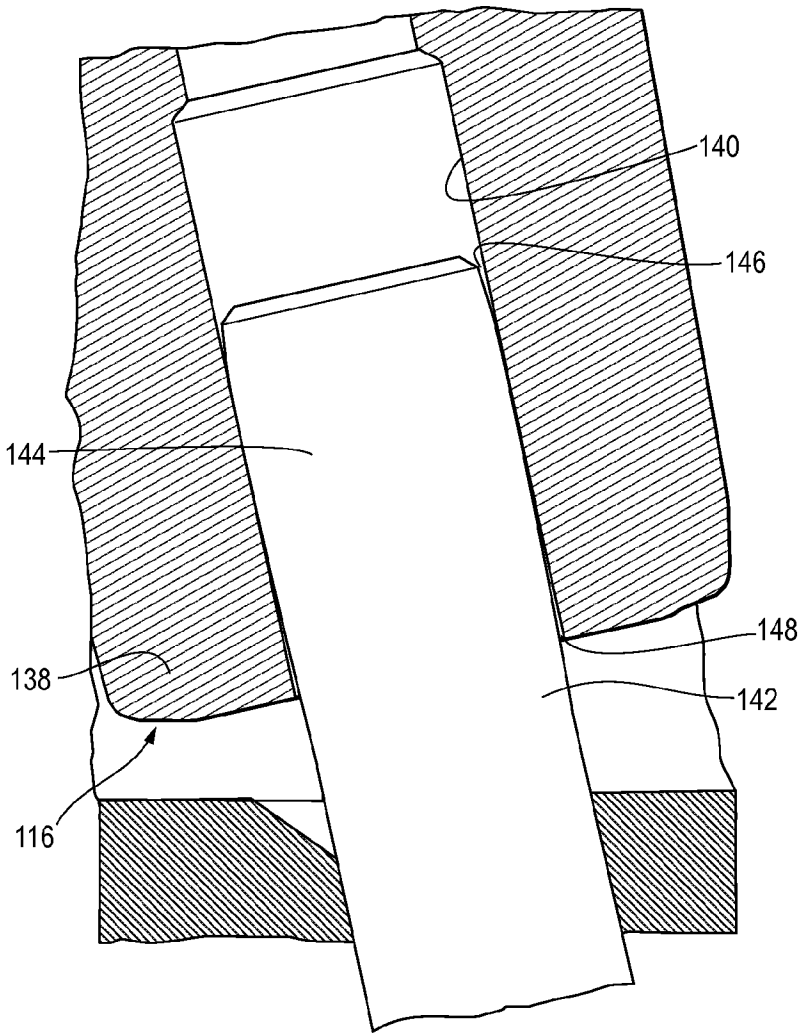
FIG. 5 is an enlarged view of the eccentric pin.

The yoke 116 of the nutating pump 100 includes a plurality of arms 118 that are adapted to engage the connecting rods 120 of the piston 114. The yoke 116 includes a retention slot 122 that is adapted to slidably engage a guide rod 124. The guide rod 124 is secured at a first end 126 to the housing 102 and is secured at a second end 128 to the valve plate 106. The yoke 116 includes a recessed center portion 130 that includes a spherical recess 132 adapted to accept pivot ball 134. Surround the spherical recess 132 are a plurality of prongs 136 that aid in retaining the ball 134 within the recess 132. The yoke 116 also includes a bottom portion 138 that includes a cylindrical recess 140. The cylindrical recess 140 is adapted to accept a tapered eccentric pin 142. The tapered eccentric pin 142, as best shown in FIG. 5, has first end 144 that is adapted to be positioned within the cylindrical recess 140 of the bottom portion 138 of the yoke 116. The tapered eccentric pin 142 includes a side wall 144 that is tapered to create gaps 146, 148, which provide additional tolerances to prevent binding of the tapered pin in the cylindrical recess 140 during operation of the nutating pump 100.

The housing 102 encases the yoke 116 and piston assemblies. The housing includes a plurality of flanges 150 that include an aperture to accept fasteners 108. The housing 152 includes a center support 152 that includes a spherical recess 154 adapted to accept the ball 134. The center support shaft 152 also includes a plurality of prongs 156 that are adapted to retain the pivot ball 134 within the spherical recess 154. The prongs 156 of the center support shaft 152 are designed so that they are positioned in between the prongs 136 of the yoke 116 when the pivot ball 134 is positioned within the spherical recesses 132, 154. When the pivot ball 134 is seated within the spherical recesses 132, 154 the prongs 136, 156 surround the ball 134 to retain its position.

Figure 4:
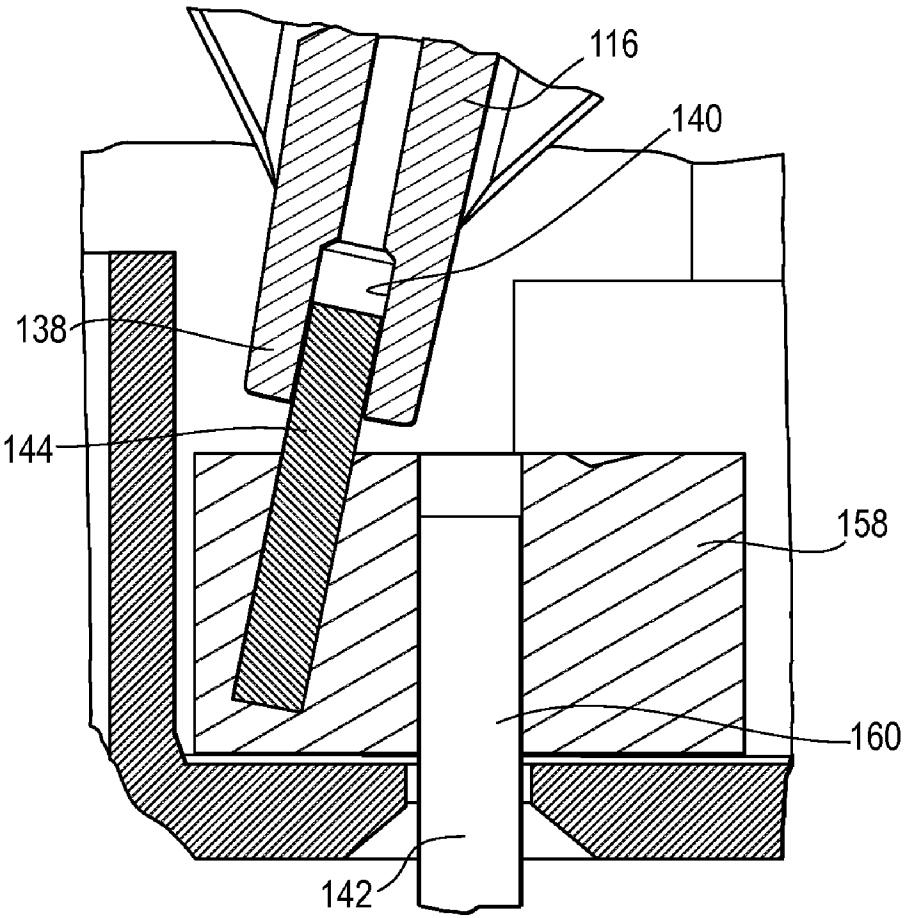
FIG. 4 is an enlarged view of a portion of the yoke.

The yoke 116 is nutated by use of an eccentric 158. The eccentric 158 is connected to the drive shaft 160 of the motor 162 as shown in FIG. 4. The eccentric 158, which is rotated by the motor 162 includes an angled bore 164 that is adapted to accept the tapered eccentric pin 142. The angled bore 164 positions the center line of the yoke 116 at an angle to the center line of the drive shaft 160, causing the yoke 116 to nutate about the ball 134. To prevent unwanted rotation of the yoke 116, the retention slot 122 engages the guide rod 124.

The arms 118 of the yoke 116 are designed to engage connecting rods 120 of the pistons 114. The arms include an end 166 that includes a spherical recess 168 that is adapted to receive ball 170. The arms also include detent 172. Opposing the end 166 of the arm 118 is the top portion 176 of the connection rod 120. The top portion 176 of the connecting rod 120 also includes a spherical recess 178 to engage ball 170 and further includes detent 181 to engage the rubber boot or sleeve 174. This arrangement allows the arm 118 of the yoke 116 to exert a downward force on the connecting rod 120. The specific sleeve arrangement as shown is preferred for use with a compression piston.

Figure 6:
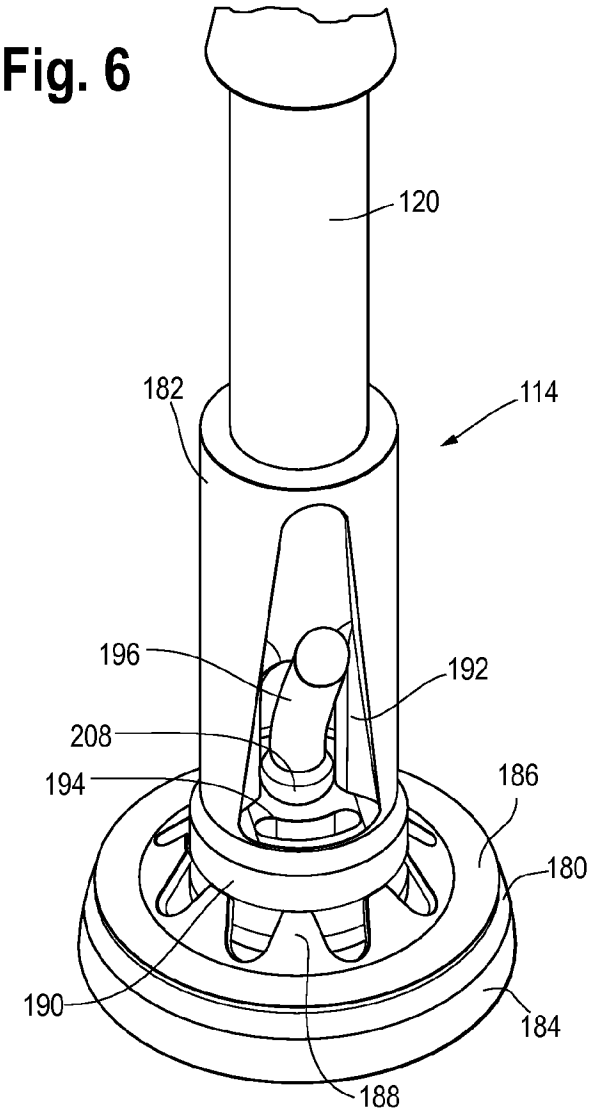
FIG. 6 is a perspective view of the piston of the pump.
Figure 7:
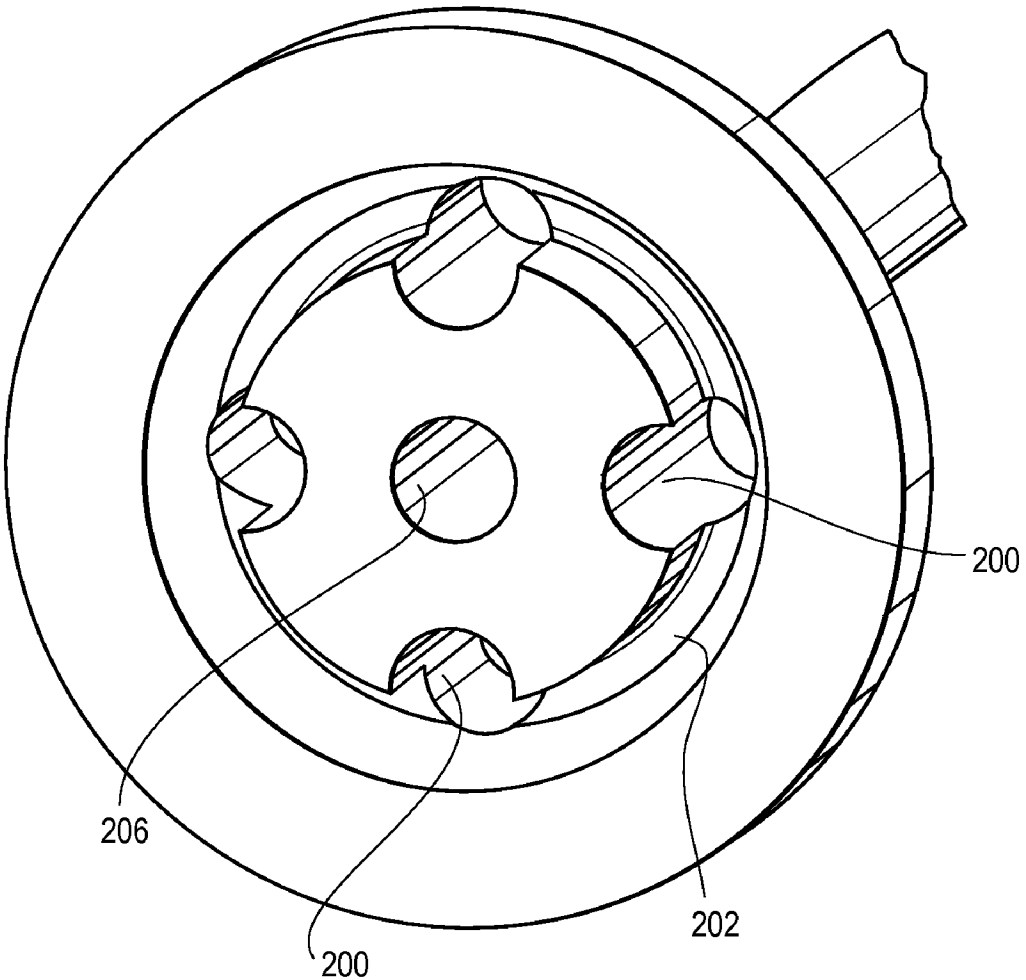
FIG. 7 is another perspective view of the piston.

The piston 114, as best shown in FIGS. 6 and 7, is formed with the connecting rod 120 and includes a head portion 180 and a base portion 182. The head portion 180 of the piston 114 includes a piston cup seal adapted to engage the inner wall of the cylinder 112. The piston cup seal 184 is retained in position by use of a retaining clip 186. The retaining cup 186 includes a plurality of fingers 188 that are biased toward the piston head portion 180 and are secure beneath lip 190.

The base portion 182 of the piston 114 forms the opening for the inlet valve. The base portion 182 of the disclosed embodiment includes a pair of tapered openings 192 that lead to a pair of intake slots 194. Also shown in FIG. 3 is the rubber stem 196 of the intake valve 198. The slots 194 lead to a plurality of intake apertures 200 that allow intake air to pass through the cylinder 112. The intake apertures 200 are interconnected by groove 202. The groove 202 also decreases the pathway between the apertures 200 and the intake valve 198. The overall function of the groove is to improve upon airflow entering the cylinder 112. The center aperture 204 is designed to permit the rubber stem 196 of the shown umbrella valve 198 to pass upward into the tapered opening 192.

The intake valve 198 of the preferred embodiment is manufactured from an elastomeric material of an umbrella configuration. The intake valve 198 includes an elastomeric valve head 210 that is adapted to cover the apertures 200 and the groove 202. When intake air is required, the edge of the valve head 210 flexes to allow air or gas to pass through the piston head portion 180. The intake valve 198 also includes an elastomeric valve stem 196 that is formed with the valve head 210 and is adapted to be threaded through the aperture 206 of the piston 114. The elastomeric valve stem 196 includes a bulged portion 208 that secures the valve 198 into position. During installation of the valve 198 into the piston 114, the stem 196 is threaded through the aperture 206 and pulled until the bulged portion 208 exits the aperture 206. Once the bulged portion 208 is in position, excess valve stem material is cut off and removed.

Figure 8:
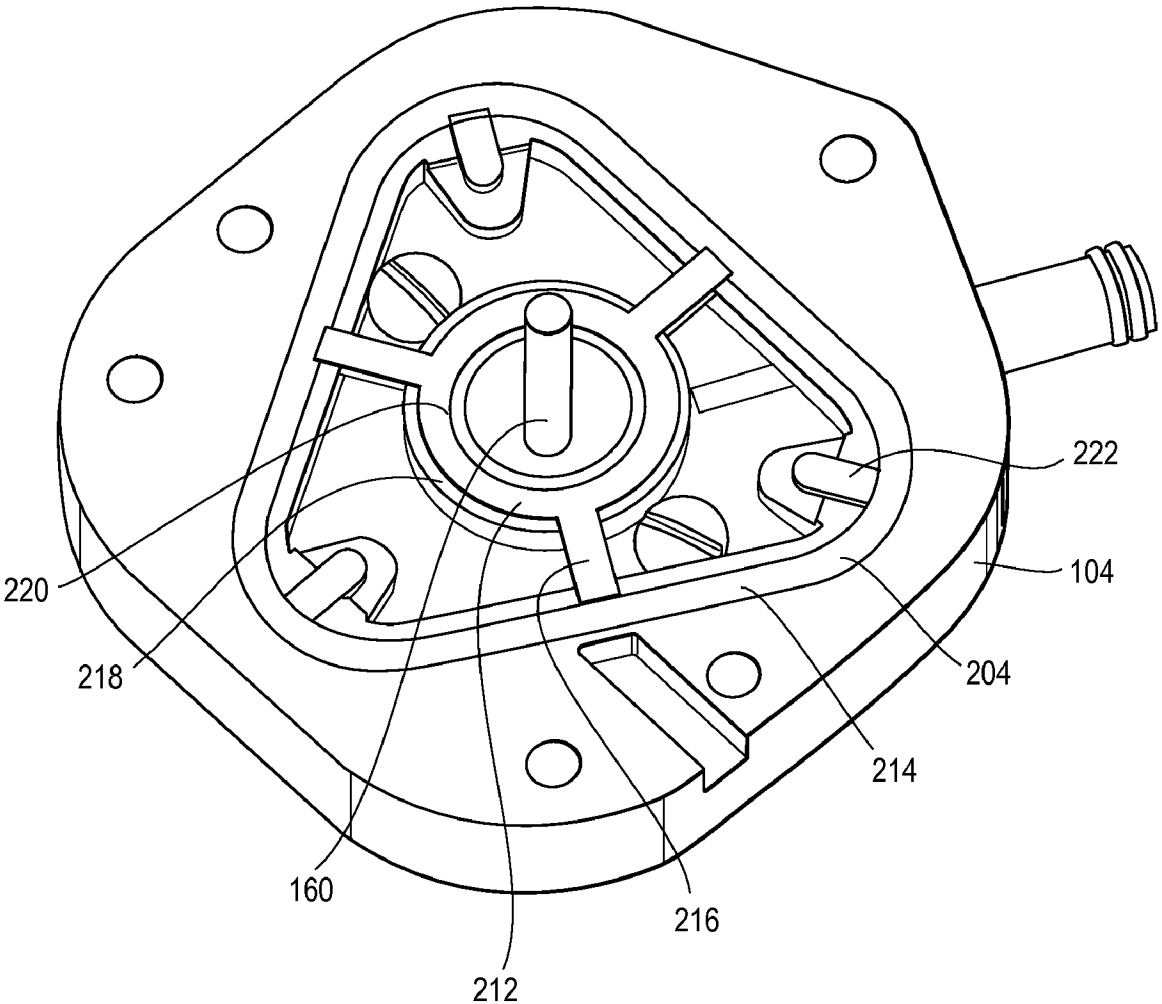
FIG. 8 is a perspective view of the valve head.
Figure 10:
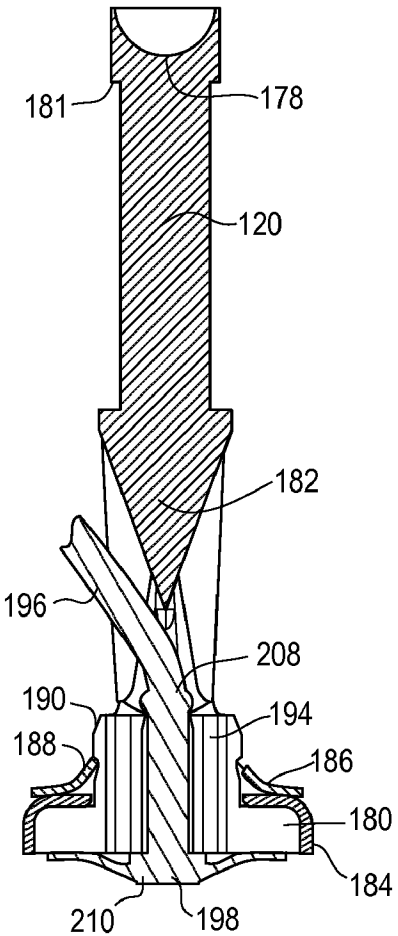
FIG. 10 is a cross sectional view of the piston.
Figure 9:
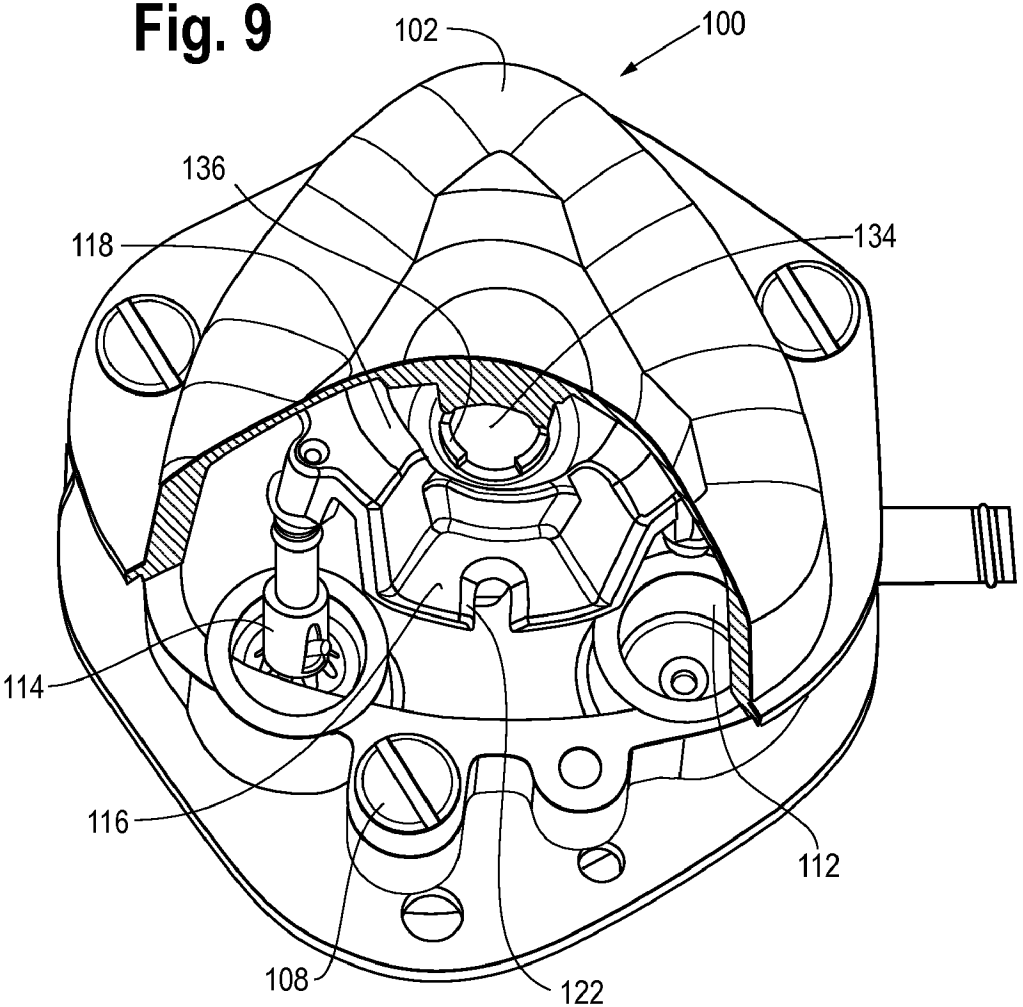
FIG. 9 is a perspective view of the top portion of the yoke.

FIG. 8 illustrates the valve head 104 of the nutating pump 100. The valve head 104 includes a unitary compressor seal and valve arrangement 204 that is adapted to seal the valve head 104 to the valve plate 106. The compressor seal 204 includes an inner elastomeric seal member 212 adapted to prevent the escape of compressed gas from around the motor drive shaft 160. To retain the position of the inner seal member 212, a pair of annular rings 218, 220 are formed in the valve head 104. The compressor seal 204 also includes an outer elastomeric seal member 214 that is adapted to prevent the escape of compressed gas. The inner and outer seal members 212, 214 are interconnected by a plurality of rib members 216 that extend between the inner and outer elastomeric seal members 212, 214. The compressor seal 204 also includes elastomeric valve members 222 that can be connected to either the inner or the outer elastomeric seal members 212, 214 or both if the valve member 222 is modified to bridge between the inner and outer seal member 212, 214.

In use, rotation of the drive shaft 160 and the eccentric 158 causes the eccentric pin 142, which is installed in the angled bore 164, to revolve about the drive shaft 160. Revolving of the eccentric pin 142 causes the yoke 116 to nutate or wobble about pivot ball 134. The yoke 116 is prevented from rotating by use of the guide rod 124. The wobbling motion of the yoke 116 causes the oscillation of the arms 118, which in turn, apply a downward and upward force on the connecting rods 120 and pistons 114. Reciprocation of the piston 114 within the cylinder 112 causes the intake valve 198 to allow the passage of air or gas through the apertures 200 of the piston 114, when the piston 114 is moving in an upward direction and to compress the air in the cylinder 112 when the piston 114 is moving in a downward direction. Downward movement of the piston 114 causes the valve member 222 of the compressor seal 204 to allow for the passage of air or gas from the cylinder 112 into the valve head 104 and ultimately out of the compressor 100.

A preferred embodiment of the invention has been described in considerable detail. Many modifications and variations to the preferred embodiment described will be apparent to a person or ordinary skill in the art. For example, split ring seals rather than cup seals could possibly be employed if the piston rods were made long enough or the wobble of the piston was otherwise reduced to make split ring seals practical. Therefore, the invention should not be limited to the embodiment described.

The invention claimed is:

1. A nutating pump for creating pressure or a vacuum, said nutating pump comprising:

a housing;

a center support positioned within said housing, said center support including a semi-spherical recess;

a drive shaft adapted to be connected to an electric motor;

an eccentric adapted to be connected to said drive shaft;

a ball adapted to form a ball joint and to be positioned within said semi-spherical recess of said center support;

said center support includes a plurality of prongs to assist in retaining the position of said ball;

a nutating yoke positioned within said housing, said yoke having a semi-spherical recess adapted to accept said pivot ball;

said nutating yoke adapted to be connected to said eccentric, such that rotation of said eccentric causes said yoke to move about said ball;

a connecting rod connected to said yoke;

a piston connected to said connecting rod;

a cylinder adapted to accept said piston; and wherein movement of said yoke about said ball causes said piston to reciprocate within said cylinder.

2. The nutating pump of claim 1, wherein said pump includes a guide rod.

3. The nutating pump of claim 2, wherein said yoke includes a retention slot that is adapted to slidably engage said guide rod to prevent rotation of said yoke about said ball joint.

4. The nutating pump of claim 1, wherein said piston includes a valve adapted to permit gas to enter said cylinder through said piston.

5. The nutating pump of claim 1, wherein said cylinder includes apertures adapted to permit gas to exit said cylinder.

6. The nutating pump of claim 1, wherein said nutating pump includes a valve head.

7. The nutating pump of claim 6, wherein said valve head includes a one piece gasket having a plurality of sealing surface to for independent sealed chambers.

8. The nutating pump of claim 7, wherein said gasket includes a plurality of elastomeric valves.

9. The nutating pump of claim 8, wherein said elastomeric valves are adapted to permit gas to exit said cylinders.

10. The nutating pump of claim 8, wherein said piston includes a plurality of apertures adapted to permit gas to flow through said piston.

11. The nutating pump of claim 10, wherein said piston includes an annular groove that is in fluid communication with said plurality of apertures.

12. The nutating pump of claim 1 further comprising a ball between said connecting rod and an arm of said nutating yolk; and an elastomeric member coupling said arm to said connecting rod.

13. A nutating pump for creating pressure or a vacuum, said nutating pump comprising:

a housing;

a center support positioned within said housing, said center support including a semi-spherical recess;

a drive shaft adapted to be connected to an electric motor;

an eccentric adapted to be connected to said drive shaft;

a ball adapted to form a ball joint and to be positioned within said semi-spherical recess of said center support;

a nutating yoke positioned within said housing, said yoke having a semi-spherical recess adapted to accept said pivot ball;

said yoke is pivotally connected to said eccentric by an eccentric pin having a tapered side;

said nutating yoke adapted to be connected to said eccentric, such that rotation of said eccentric causes said yoke to move about said ball;

a connecting rod connected to said yoke;

a piston connected to said connecting rod;

a cylinder adapted to accept said piston; and wherein movement of said yoke about said ball causes said piston to reciprocate within said cylinder.

14. A piston for use in a compressor comprising:

a head portion having a first side, a second side and a perimeter;

a base portion connected to said head portion;

a seal connected to and extending beyond the perimeter of said head portion;

said seal is a cup seal and said cup seal is retained on said piston by way of a retainer clip;

a plurality of apertures extending through said head portion, said apertures adapted to permit gas to pass from said first side to said second side of said head portion;

an annular groove in fluid communication with said apertures; and a valve connected to said piston, said valve adapted to selectively permit gas to pass through said apertures.

15. The piston of claim 14 wherein said retainer clip includes a plurality of fingers that are biased to engage said piston.

16. The piston of claim 14 wherein said piston includes a centralized aperture.

17. A piston for use in a compressor comprising:

a centralized aperture;

a head portion having a first side a second side and a perimeter;

a base portion connected to said head portion;

a seal connected to and extending beyond the perimeter of said head portion;

a plurality of apertures extending through said head portion, said apertures adapted to permit gas to pass from said first side to said second side of said head portion;

an annular groove in fluid communication with said apertures;

a valve connected to said piston, said valve adapted to selectively permit gas to pass through said apertures; and said valve includes a flexible shaft adapted to be positioned within said centralized aperture.

18. The piston of claim 17 wherein said flexible shaft includes a retaining member to secure said valve to said piston.

19. The piston of claim 18 wherein said retaining member is in the form of an enlarged portion of said flexible shaft.

20. A piston for use in a compressor comprising:

a head portion having a first side a second side and a perimeter;

a base portion connected to said head portion;

a seal connected to and extending beyond the perimeter of said head portion;

at least one passageway extending through said head portion, said at least one passageway adapted to permit gas to pass from said first side to said second side of said head portion;

an aperture extending through said head portion of said piston;

a valve connected to said piston, said valve having a flexible shaft adapted to be positioned within said aperture;

a retainer in the form of an enlarged portion of said flexible shaft, said retainer adapted to retain said valve to said piston.

* * * * *

UNITED STATES PATENT AND TRADEMARK OFFICE

CERTIFICATE OF CORRECTION

PATENT NO. : 7,451,687 B2
APPLICATION NO. : 11/275402
DATED : November 18, 2008
INVENTOR(S) : William Harry Lynn et al.

It is certified that error appears in the above-identified patent and that said Letters Patent is hereby corrected as shown below:

Title page, item (75) Inventors: William Harry Lynn, Kohler, WI (US)
change "Roy Razek, Plymouth, WI (US)" to
"Roy Rozek, Plymouth, WI (US)"

Signed and Sealed this

Seventeenth Day of February, 2009

JOHN DOLL
*Acting Director of the United States Patent and Trademark Office*